US005621512A

United States Patent [19]

Uehara et al.

[11] Patent Number: 5,621,512

[45] Date of Patent: Apr. 15, 1997

[54] IMAGE FIXING DEVICE HAVING AN ENDLESS BELT AND NON-ROTATING PRESSURE-APPLYING MEMBER

[75] Inventors: Yasuhiro Uehara; Yasuhiro Kusumoto; Yoshio Kanesawa, all of Nakai-machi, Japan

[73] Assignee: Fuji Xerox Co., Ltd., Tokyo, Japan

[21] Appl. No.: 573,374

[22] Filed: Dec. 15, 1995

[30] Foreign Application Priority Data

Mar. 24, 1995 [JP] Japan ..... 7-065629

[51] Int. Cl.[6] ..... G03G 15/20

[52] U.S. Cl. ..... 399/328; 399/330; 399/334; 399/338

[58] Field of Search ..... 355/285, 289, 355/290, 295, 282; 219/216

[56] References Cited

U.S. PATENT DOCUMENTS

| | | | |
|---|---|---|---|
| 5,053,829 | 10/1991 | Field et al. | 355/290 |
| 5,070,373 | 12/1991 | Fukano et al. | 355/290 |
| 5,148,226 | 9/1992 | Setoriyama et al. | 355/290 |
| 5,210,579 | 5/1993 | Setoriyama et al. | 355/285 |
| 5,257,078 | 10/1993 | Kuroda | 355/290 |
| 5,345,300 | 9/1994 | Uehara et al. | 355/285 |
| 5,359,401 | 10/1994 | Uehara et al. | 355/85 |
| 5,386,281 | 1/1995 | Mitani et al. | 355/290 |
| 5,485,259 | 1/1996 | Uehara et al. | 355/285 X |
| 5,499,087 | 3/1996 | Hiraoka et al. | 355/285 |

FOREIGN PATENT DOCUMENTS

| | | |
|---|---|---|
| 52-69337 | 6/1977 | Japan . |
| 60-104852 | 7/1985 | Japan . |
| 60-151677 | 8/1985 | Japan . |
| 60-151681 | 8/1985 | Japan . |
| 62-14675 | 1/1987 | Japan . |
| 2-30961 | 2/1990 | Japan . |
| 4-050885 | 2/1992 | Japan . |
| 5-150679 | 6/1993 | Japan . |
| 6-250560 | 9/1994 | Japan . |
| 7-129004 | 5/1995 | Japan . |
| 7-219380 | 8/1995 | Japan . |

*Primary Examiner*—Matthew S. Smith
*Attorney, Agent, or Firm*—Oliff & Berridge

[57] ABSTRACT

The present invention provides an image fixing device including a heat fusing roller with heating means inside and an elastic material layer on a peripheral surface of the heat fusing roller, the heat fusing roller being rotatably mounted, an endless belt movable in contact with the heat fusing roller, and a pressure applying member fixed and contacting the endless belt on the heat fusing roller and applying pressure to form a belt nip portion between the endless belt and the heat fusing roller.

20 Claims, 5 Drawing Sheets

IMAGE FIXING DEVICE HAVING AN ENDLESS BELT AND NON-ROTATING PRESSURE-APPLYING MEMBER

BACKGROUND OF THE INVENTION

1. Field of the Invention

The present invention relates to an image fixing device which performs heat fusing of an unfixed toner image in an image formation apparatus utilizing the electro-photographic method, such as a copying machine, a printer or a facsimile apparatus and in particular relates to an image fixing device adopting a belt nip method.

2. Discussion of the Related Art

FIG. 8 shows an image fixing device proposed by inventors of the present invention and disclosed by Japanese Patent Application Unexamined Publication No. Hei. 5-150679 (1993). In the figure, the reference number 1 indicates a heat fusing roller rotatably disposed. The heat fusing roller 1 is made by forming a coating layer 4 of an elastic material on the surface of a core 3 which is a cylinder made of metal with high thermal conductivity, for example, aluminum. The coating layer 4 comprises an under coating layer 20 of HTV (High Temperature Vulcanization) silicone rubber formed directly on the surface of the core 3 and a top coating layer 21 of RTV (Room Temperature Vulcanization) silicone rubber formed to cover the under coating layer 20.

As a heat source, a halogen lamp 5 is disposed inside of the core 3. A temperature sensor 6 is disposed at the surface of the heat fusing roller 1 to measure the surface temperature of the heat fusing roller 1. In accordance with a measurement signal of the temperature sensor 6, a temperature controller (not shown in the figure) is operated to control the halogen lamp 5, whereby temperature of the surface of the heat fusing roller 1 is controlled to be a predetermined value. As releasing agent, silicone oil is supplied to the surface of the heat fusing roller 1 by an oil supplying device 9; therefore offset of a part of toner 8 to the heat fusing roller 1 is prevented in fixing an unfixed image of toner 8 to a sheet 7.

A pressure roller 25 is pressed to the heat fusing roller 1 by a compressed coil spring 26, and an assist pressure roller 29 is pressed to the heat fusing roller 1. Rollers 22, 23 and 24 are mounted to support an endless belt 15 so that part of the endless belt 15 is disposed between the heat fusing roller 1 and the pressure rollers 25 and 29.

The pressure roller 25 is contacted to the heat fusing roller 1 with pressure at a position higher than that of the roller 24, whereby the endless belt contacts to the heat fusing roller 1 and an area where the heat fusing roller 1 and the endless belt 15 contact each other is made to be a nip portion (hereinafter, referred to as a belt nip) for passing the sheet 7 therethrough. As according to rotation of the heat fusing roller 1 and the endless belt 15 in a direction indicated by an arrow, the sheet 7 is forwarded between rotating heat fusing roller 1 and endless belt 15. When the sheet 7 is passed through the belt nip, unfixed toner 8 is fixed to the sheet 7 by pressure applied to the belt nip and heat provided by the halogen lamp 5 through the heat fusing roller 1.

With such belt nip method construction, because the sheet 7 is heated for the time corresponding to the width of the belt nip (length of the part of the belt pressed by the pressure roller 25 and the assist pressure roller 29 in the figure), it is possible to securely obtain sufficient fixing time even if the carrying speed of the sheet 7 is increased in comparison with the case where only the heat fusing roller 1 and the pressure roller is press-contacted each other without using the endless belt 15. In the case of the same carrying speed, the heating time in the belt nip method is longer than that in a method in which the endless belt is not used, and therefore large amount of heat can be supplied to the toner. Consequently, the belt nip method is particularly suitable for image fixing by a color copying machine which produces desired colors by multi-layered toner.

According to the image fixing device of the present invention, the sheet 7 can be stripped from the heat fusing roller 1 without stripping means such as stripper fingers used in the ordinary image fixing device comprising only the heat fusing roller and the pressure roller (hereinafter, this is referred to as self-stripping). Consequently, a thin recording sheet which is soft and is difficult to be stripped or a recording sheet to which a large amount of toner is fused can be stripped by self-stripping.

During the study of self-stripping method for a thin recording sheet, that is, a method of reducing adhesive force between the fixing roller and melted toner, the inventors of the present invention discovered the following phenomenon.

The adhesive force at an interface of melted toner and the surface of the fixing roller is not only determined by their surface-chemistrical material properties, but also influenced largely by strain of the fixing roller. That is, the adhesive force between toner and the surface of the fixing roller is reduced when a state that the surface of the fixing roller is already strained and melted toner is fused thereon is changed to another state that strain of the surface of the fixing roller is restored in a moment.

To be concrete, if the surface of the fixing roller is coated with material which can be elastically deformed and strained by the load applied from the outside, for example, heat-resisting elastic material such as silicone rubber or fluororubber, the adhesive force between toner and the surface of the fixing roller is severely reduced at the moment when the strain of the surface of the fixing roller made by being contacted and applied pressure by a hard roller of small diameter for fixing is restored at the exit point of the nip; accordingly, self-stripping of the recording sheet is performed with ease.

The mechanism of reduction of the adhesive force is not yet made clear, but inventors of the present invention consider this as follows.

When the pressure is applied, the surface of a soft roller which is coated with elastic material is deformed; therefore it is in contact with toner in the state of being strained. When the pressure is removed suddenly from the soft roller which is strained, strain is restored and the soft roller is returned to the former state of shape. At this time, a slight slip occurs at the interface of the toner and the roller, and the slight slip is assumed to be the cause of the adhesive force reduction effect.

In the case of the hard roller whose surface is not deformed, no slight slip occurs. Therefore, adhesive force reduction effect cannot be obtained. The present invention applies this idea to the belt nip method.

Other image fixing devices adopting belt nip method are disclosed by Japanese Patent Application Unexamined Publications Nos. Sho. 52-69337 (1977), Sho. 60-151677 (1985), Sho. 60-151681 (1985), Sho. 62-14675 (1987), Japanese Utility Model Application Unexamined Publications Nos. Sho. 60-104852 (1985) and Hei. 2-30961 (1990).

However, the image fixing devices adopting the belt nip method described above have the following problems:

1) Because the pressure roller 25 and the assist pressure roller 29 pressing the endless belt 15 toward the heat fusing roller 1 rotate as according to the movement of the endless belt 15, the pressure roller 25 and the assist pressure roller 29 carry away a large amount of heat from the heat fusing roller 1. It is uneconomical, and besides, the surface temperature suddenly drops, whereby fixing capability of toner is influenced badly.

2) Because the coating layer 4 is slightly strained by the pressure-contacting force of the pressure roller 25, if supposing that peripheral velocity of the heat fusing roller 1 is $V_0$, and strain of the coating layer 4 in the circumferential direction is $\epsilon$, the velocity of the strained portion $V_\epsilon$ is represented as follows (See FIG. 9):

$$V_{68} = V_0(1+\epsilon)$$

In the belt nip, the frictional coefficient between the sheet 7 and the heat fusing roller 1 is considered to be constant anywhere in the sheet 7. The force of the endless belt 15 pressing the sheet 7 to the heat fusing roller 1 by itself is not so large, and accordingly, it is considered that the largest frictional force is generated at the portion in contact with the pressure roller 25 which applies the largest load. Moreover, elongation of the sheet 7 is considered to be extremely small. Therefore, the sheet 7 is carried at the velocity $V_{P1}$ which is close to the velocity $V_\epsilon$The part of the heat fusing roller corresponding to the belt nip moves at the peripheral velocity $V_0$ and the sheet 7 is carried at the velocity $V_{P1}$, and consequently, the following velocity difference occurs between them:

$$\epsilon V_0 \approx V_{P1} - V_0$$

Owing to this velocity difference in the belt nip, the unfixed image of toner 8 is disordered, which results in image displacement in an obtained fixed image.

For this reason, in the device disclosed by Japanese Patent Application Unexamined Publication No. Hei. 5-150679, the assist pressure roller 29 is disposed at the upper side of the pressure roller 25 in the direction of movement of the sheet 7 and pressed to the heat fusing roller 1 by a spring which is not shown in the figure. Therefore, even if the end of the sheet 7 reaches the pressure roller 25 and is going to be carried at the velocity $V_{P1}$ which is close to the velocity $V_\epsilon$, it is possible to carry the sheet 7 at the peripheral velocity $V_0$ by pressing the following portion of the sheet 7 to the heat fusing roller 1 by the assist pressure roller 29 to prevent occurrence of difference in velocities between the heat fusing roller 1 and the sheet 7 which causes image displacement. However, it is difficult to securely avoid the image displacement only by means of mounting the assist pressure roller 29. If the assist pressure roller 29 is mounted, the device will be complex and bulky, and besides, the number of the components increases, thus being uneconomical.

3) If the sheet 7 and toner 8 is heated in the belt nip, air and water vapor swell and vaporize from the heated sheet 7 or toner 8. Such air and water vapor turn to bubbles in the belt nip, to be more detail, between the sheet 7 and the heat fusing roller 1 or the endless belt 15, until the sheet 7 passes through the belt nip.

Apart from portions pressed by the pressure roller 25 and the assist pressure roller 29, pressure sufficient to fix the toner 8 to the sheet 7 cannot be applied between the heat fusing roller 1 and the endless belt 15 because of interposition of the bubbles. Besides, in the case where the sheet 7 is in the belt nip and the toner 8 is not fixed completely, sometimes unfixed toner 8 is undesirably moved by the bubbles vaporized from the sheet 7. In a method using a heat fusing roller and a pressure fixing roller without an endless belt, such inconvenience hardly occurs because of a small nip width, but in the belt nip method there is a large possibility of displacement of toner image by the bubbles since the nip width is large. In the practical use, there occurs a problem of image bleeding or displacement considered to be caused by the bubbles.

SUMMARY OF THE INVENTION

The present invention has been made in view of the above circumstances and has as an object of provision of an image fixing device which overcomes the above described problems.

Another object of the present invention is to provide an image fixing device which reduces the heat loss in a belt nip and prevents image disorder caused by air or water vapor in the belt nip or difference in velocities between a sheet and a heat fusing roller.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims. To achieve the objects and in accordance with the purpose of the invention, as embodied and broadly described herein, an image fixing device of the present invention comprises a heat fusing roller including heating means inside thereof and an elastic material layer on a peripheral surface of the heat fusing roller, the heat fusing roller being rotatably mounted, an endless belt movable in contact with the heat fusing roller, and a pressure applying member fixed and contacting the endless belt on the heat fusing roller and applying pressure to form a belt nip portion between the endless belt and the heat fusing roller.

BRIEF DESCRIPTION OF THE DRAWINGS

The accompanying drawings, which are incorporated in and constitute a part of this specification illustrate embodiment of the invention and, together with the description, serve to explain the objects, advantages and principles of the invention. In the drawings.

DETAILED DESCRIPTION OF THE PREFERRED EMBODIMENT

Preferred embodiment of an image fixing device according to the present invention is now described in detail based on the drawings.

First Embodiment

Figure 1:
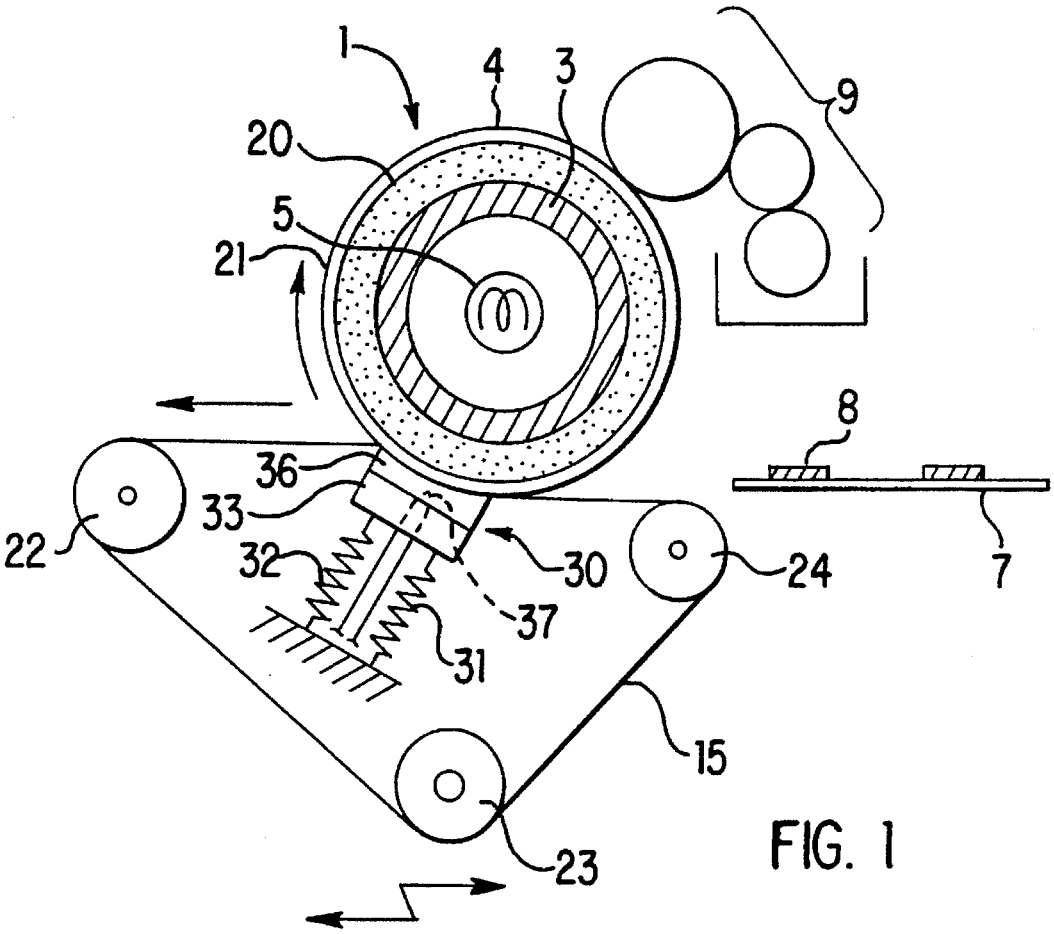
FIG. 1 is a side elevational view showing the construction of a first embodiment of an image fixing device according to the present invention.
Figure 8:
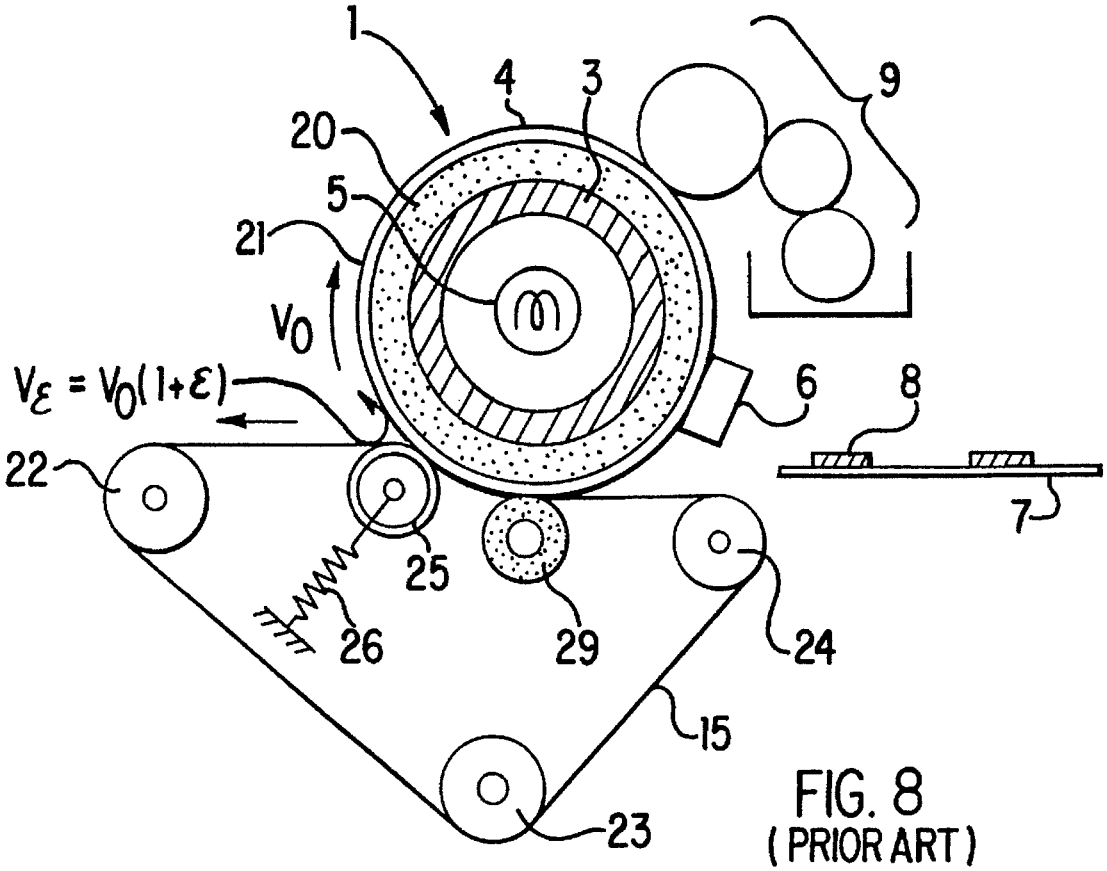
FIG. 8 (PRIOR ART)
FIG. 8 is a side elevational view showing an example of conventional image fixing device.
Figure 9:
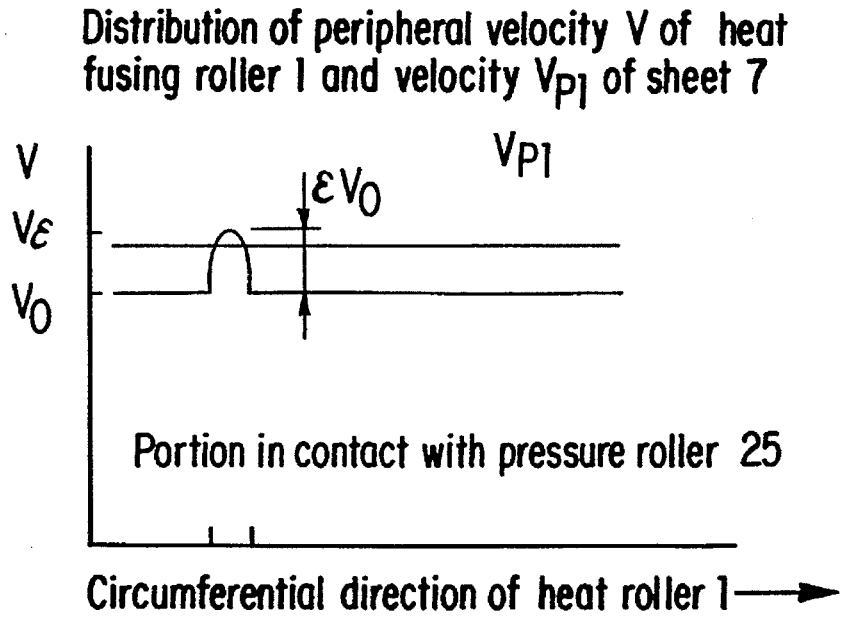
FIG. 9 is a graph showing a relation between sheet carrying velocity and peripheral velocity distribution of a pressure fixing roller in the conventional image fixing device.

FIG. 1 is a side elevational view showing a first embodiment of an image fixing device according to the present invention. In this embodiment, a heat fusing roller 1, which is the same as shown in FIG. 8, is used. A core 3 of the heat fusing roller 1 is an iron cylinder having 25 mm outer diameter, 24.4 mm inside diameter and 350 mm length. The surface of the core 3 is directly coated with 45° hardness HTV silicone rubber having 0.5 mm thickness as an under coating layer 20, and further coated with RTV silicone rubber of 50 μm thickness as a top coating layer 21 by means of dip coating method, whereby a coating layer 4 is formed. The surface of the coating layer 4 is close to a mirror finish. The hardness of the rubber of the under coating layer 20 is measured with a durometer type A (spring type) manufactured by TECLOCK Corporation, in accordance with JIS-K 6301, by applying load of 1,000 gf. The material of the core 3 is not limited to iron: any metal having high heat conductivity may be used. As the coating layer 4, material other than the above-described one can be used as long as it is an elastic material with high heat resistivity.

Inside the core 3, a 400 W halogen lamp 5 is disposed as the heat source. The temperature of the surface of the heat fusing roller 1 is measured by a temperature sensor 37 which will be described later. In accordance with the measurement signal of the temperature sensor 37, feedback control is applied to the halogen lamp 5 by a temperature controller (not shown in the figure), thus controlling the surface temperature of the heat fusing roller 1 to be 150° C.

An oil supplying device 9 is disposed near the heat fusing roller 1 for supplying a predetermined amount of releasing agent to the surface of the heat fusing roller 1. Thereby offset of part of toner 8 to the heat fusing roller 1 is prevented in fixing an unfixed image of toner 8 to a sheet 7. As the releasing agent supplied by the oil supplying device, dimethyl silicone oil of 300 cs viscosity ("KF-96", a product name of Shin-Etsu Chemical Co., Ltd.) is used here.

Beneath the heat fusing roller 1, an endless belt 15 supported by stainless rollers 22, 23 and 24 is disposed. The endless belt 15 is made of a polyimide film having 75 μm thickness, 300 mm width and 157 mm circumferential length and is supported by the rollers 22, 23 and 24 with tension of 8 kgf. To prevent disengage of the endless belt 15 from the rollers 22, 23 and 24 by shift of the endless belt 15 toward the axis direction of rollers 22, 23 and 24, the roller 23 is mounted slightly movable.

Though the endless belt 15 can contact the heat fusing roller 1 only by the support of the rollers 22, 23 and 24, it is moreover pressed to the heat fusing roller 1 with a predetermined load applied by a pressure pad 30. This forms a belt nip between the endless belt 15 and the heat fusing roller 1 where the sheet 7 passes through. The angle subtended at the center of the heat fusing roller 1 by the interval of the entire belt nip is 45°. In this case, the interval of the belt nip in the direction of movement of the belt is 10 mm.

The pressure pad 30 is energized by a pair of compressed coil springs 31 and 32 in the direction of center of the heat fusing roller 1. The spring 31 is mounted to apply pressure to the whole belt nip. On the other hand, the spring 32 is disposed to mainly apply pressure to vicinity of exit point of the belt nip for straining the surface of the heat fusing roller 1, which results in increase of self-stripping capability of the sheet 7.

Figure 2:
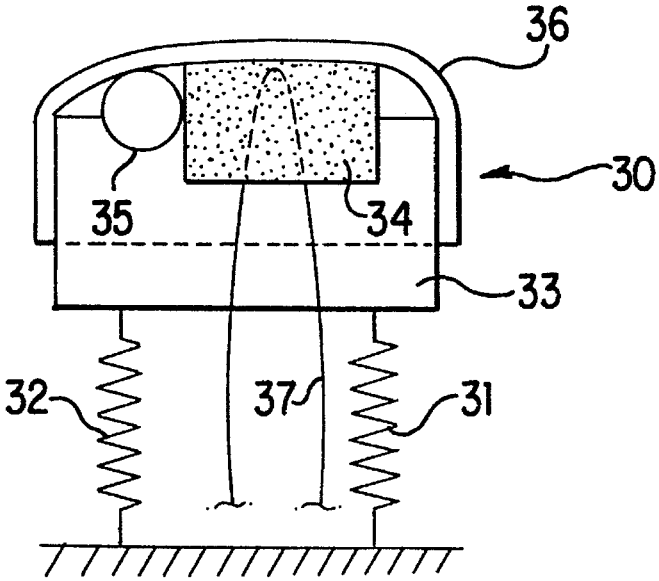
FIG. 2 is an extended side elevational view showing the construction of a pressure pad used in the first embodiment of the image fixing device according to the present invention.

FIG. 2 is a sectional view showing the pressure pad 30 in detail. The pressure pad 30 has a metal flame 33 supported by the compressed coil springs 31 and 32. On the side of the heat fusing roller of the flame 33, a soft-material member 34 and a hard-material member 35 are set and covered with a low friction sheet 36. The soft-material member 34 is a plate having 320 mm length, 7 mm width and 5 mm thickness along the longitudinal direction of the heat fusing roller 1, which is made of soft material such as silicone sponge (foaming silicone rubber) for pressing the endless belt 15 over the whole belt nip area. The hard-material member 35 is a cylinder having 320 mm length and 4 mm diameter made of material much harder than the coating layer 4, for example, a stainless pipe, for locally straining the coating layer 4 on the surface of the heat fusing roller 1 to increase self-stripping capability of the sheet 7.

Owing to disposing the soft-material member 34, the surface of the low friction sheet in contact with the endless belt 15 can conform with the peripheral surface of the heat fusing roller 1. That is, if the pressure pad 30 is pressed to the heat fusing roller 1 with the load of predetermined value or more, the surface of the low friction sheet 36 interfaces with the peripheral surface of the heat fusing roller 1. By applied force of the above-described springs 31 and 32, there are no spacings between the heat fusing roller 1 and the endless belt 15, and between the endless belt 15 and the low friction sheet 36.

In a preferred embodiment, the applied force of the pressure applying member against the heat fusing roller through the endless belt is such that at least 3% of surface strain in the circumferential direction occurs on the elastic material layer of the heat fusing roller.

As the low friction sheet 36, for example, "FGF-400-4" (a product name of Chukoh Chemical Industries, Ltd.), a glass fiber sheet impregnated with polytetra-fluoroethylene is used. Thereby the endless belt 15 smoothly slides on the pressure pad 30.

The heat fusing roller 1 is rotated by a motor (not shown in the figure) at the peripheral velocity $V_0$=120 mm/sec, and the endless belt 15 is also rotated following thereto.

The temperature sensor 37 described above is a thermocouple, the end of which is embedded in the soft-material member 34.

The toner image of toner 8 is transferred to the sheet 7 by a transfer device not shown in the figure and the sheet 7 is forwarded from the right side of the figure to the belt nip. The sheet 7 is entered the belt nip on the side where the pressure pad 30 is disposed. The toner image of toner 8 is fixed to the sheet 7 by pressure applied to the belt nip and heat provided by the halogen lamp 5 through the heat fusing roller 1.

Because the pressure pad 30 does not rotate, it is difficult to radiate heat conducted by the heat fusing roller 1, that is, even if the heat fusing roller 1 starts to rotate and the endless belt 15 also rotates following thereto, the heat fusing roller 1 is deprived of a little amount of heat. It is economical because of a little heat loss, and moreover, fusing capability of the toner 8 is improved since lowering of the temperature in the belt nip is restrained.

In this embodiment, the temperature sensor 37 is mounted inside the pressure pad 30 which faces the belt nip. It was impossible for the conventional rotating pressure roller 25 to have the temperature sensor inside thereof. The pressure pad 30 does not rotate, whereby it is possible. Conventionally, the temperature sensor has necessarily measured the surface temperature of the heat fusing roller 1 at a position out of the belt nip. However, with the construction of this embodiment, the temperature in the belt nip can be measured, and accordingly, more precise temperature control is realized.

In a conventional image fixing device, the surface of the heat fusing roller 1 is worn out or damaged by direct contact with the temperature sensor in some cases. In particular, the heat fusing roller 1 whose surface is coated with the coating layer 4 made of elastic material is greatly influenced, whereby shortening of life or deterioration of image quality is induced. However, this embodiment resolves such inconveniences by embedding the temperature sensor 37 in the pressure pad 30.

Moreover, in this embodiment, wider area of the endless belt 15 can be pressed in comparison with cases where only the conventional pressure roller 25 is used or the assist pressure roller 29 is added thereto (See FIG. 8). This is utilized to control the pressure distribution in the belt nip with ease. Furthermore, the effect described as follows is also obtained.

Figure 3:
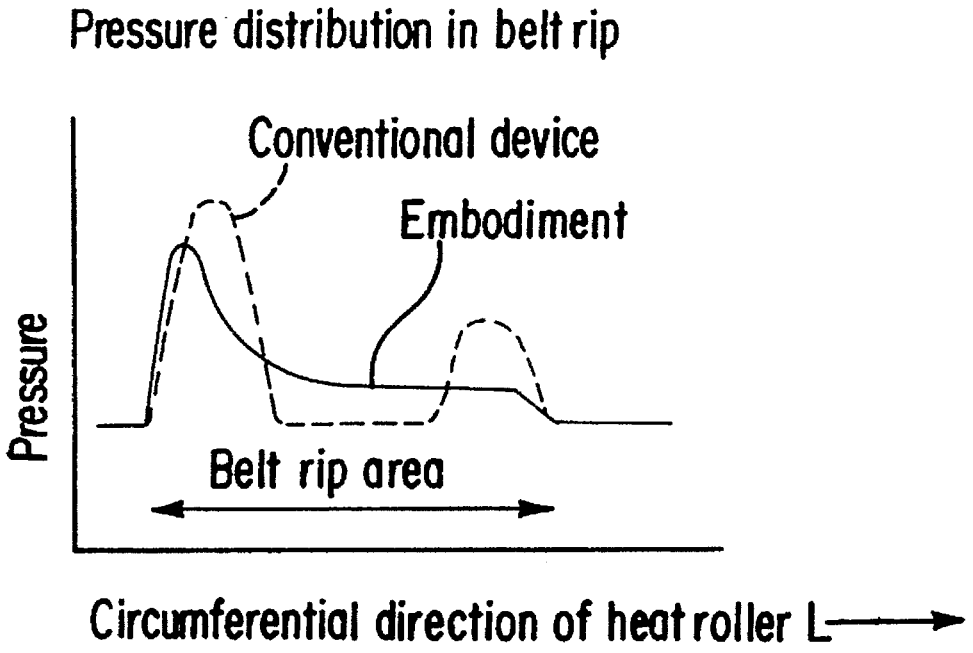
FIG. 3 is a graph showing distribution of pressure in a belt nip in the first embodiment of the image fixing device and the conventional image fixing device.

FIG. 3 is a graph showing the pressure distribution in the belt nip, wherein a solid line indicates the pressure distribution in this embodiment and a broken line indicates that of the conventional art shown in FIG. 8. In the conventional art, high pressure is applied only in the portions pressed by the pressure roller 25 and the assist pressure roller 29. On the other hand, in this embodiment, the pressing force of the spring 31 can be applied to the whole belt nip area by means of the pressure pad 30.

Figure 4:
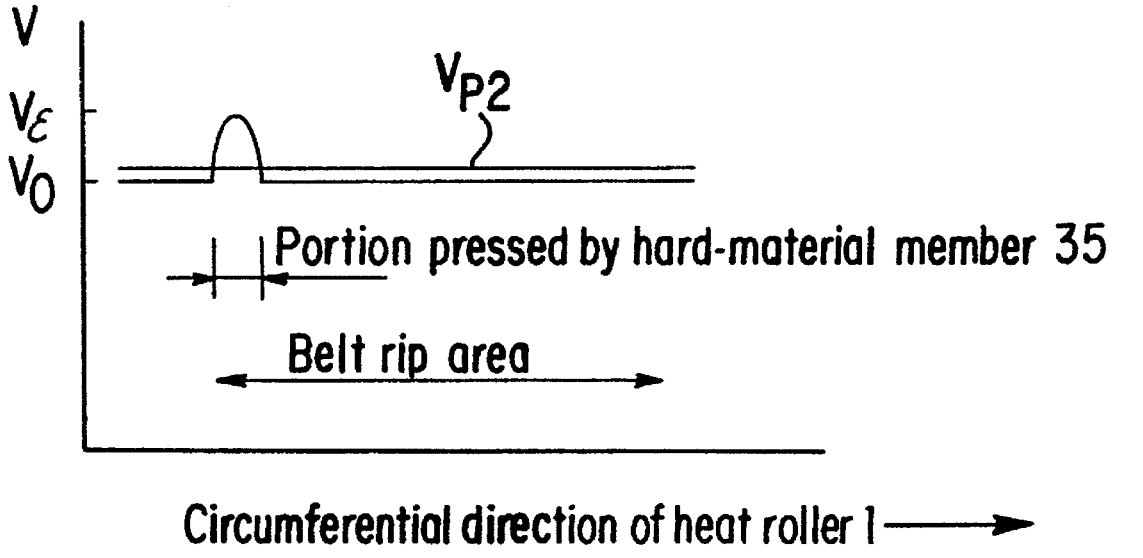
FIG. 4 is a graph showing a relation between sheet carrying velocity and peripheral velocity distribution of a heat fusing roller in the first embodiment of the image fixing device according to the present invention.

The peak of the solid line is found at the position of hard-material member 35 because the load of the spring 32 concentrates thereon due to the hardness of the hard-material member 35. For this reason, the part of the coating layer 4 on the heat fusing roller 1 pressed by the hard-material member 35 is strained and self-stripping of the sheet 7 can be performed. As shown in FIG. 4, the velocity in the pressed portion is larger than the peripheral velocity $V_0$ in other portions of the heat fusing roller 1 owing to strain. Therefore, when the top end of the sheet 7 going to pass the belt nip reaches the hard-material member 35, the velocity of the sheet 7 which has been $V_0$ increases to $V_{P2}$ under the influence of the velocity $V_\epsilon$ in the strained portion of the heat fusing roller 1.

However, in this embodiment, pressure is applied to the belt nip by the pressure pad 30, in particular by the soft-material member 34 (shown in FIG. 2), the following part of the sheet 7 can also be pressed; accordingly, little velocity increases. That is, the sheet 7 moves at the velocity $V_{P2}$ which is almost the same as the peripheral velocity $V_0$ in other portions of the heat fusing roller 1. Thus, in the belt nip where the toner image is fixed, difference in velocities of the heat fusing roller 1 and the sheet 7 is small, whereby extremely little image displacement occurs.

From a viewpoint of pressing the following part of the sheet 7, it is desirable that the pressure applied to an inlet point of the belt nip through the soft-material member 34 is larger and larger. However, if it is too large, trouble may occur such that the sheet 7 does not enter the belt nip or the sheet 7 changes its moving velocity when entering the belt nip, which results in image displacement.

In the first embodiment, the pressure at the inlet point of the belt nip is smaller than that of the exit point by mounting the plate-like soft-material member 34, and therefore the sheet 7 can smoothly enter the belt nip and occurrence of the image displacement is restrained.

Thus, it is possible to reduce variation of velocity of the sheet 7 in the belt nip, to make the difference in velocities small between the heat fusing roller 1 and the sheet 7, and to restrain disorder of unfixed image of toner 8, whereby image displacement in an obtained fixed image can be prevented.

Moreover, the endless belt 15 can be pressed to the heat fusing roller 1 over the whole belt nip area so that no spacing is found between them for making it possible for the pressure pad 30 to press the endless belt 15 over the whole belt nip area. Thus expansion and vaporization of air and water vapor in the sheet 7 or the toner 8 can be restrained, that is, generation and growth of bubbles in the belt nip can be restrained. Accordingly, it is possible to prevent disorder of unfixed toner 8 by grown bubbles, and at the same time, it is possible to securely press the toner 8 on the sheet 7 passing through the belt nip with the endless belt 15 and the heat fusing roller 1 for fixing the image.

Next, an example of setting of the load of springs 31 and 32 in this embodiment is described. The load of the spring 32 must cause self-stripping of the sheet 7. Table 1 shows results of experiment which investigates self-stripping capability by using springs of different loads.

TABLE 1

| Load of spring 32 (kgf) | Basis weight 55 g/m² | | 65 g/m² | | 90 g/m² | |
|---|---|---|---|---|---|---|
| | Direction | | | | | |
| | A | B | A | B | A | B |
| 0 | ** | ** | ** | ** | ** | ** |
| 1 | ** | ** | ** | * | ** | * |
| 2 | ** | ** | ** | * | ** | * |
| 3 | ** | * | ** | * | ** | * |
| 4 | ** | * | ** | * | * | * |
| 5 | ** | * | * | * | * | * |
| 6 | * | * | * | * | * | * |
| 7 | * | * | * | * | * | * |
| 8 | * | * | * | * | * | * |

In this experiment, three types of paper having different basis weights, 55 g/m², 65 g/m² and 90 g/m², are used as the sheet 7 on which color toner is transferred with 3.0 mg/cm² density, and paper self-stripping capability at the exit point of the belt nip is examined. The sheets are carried in two ways: carrying the sheet in a direction in which orientation of paper fiber is parallel to the heat fusing roller 1 (indicated as "A" in Table 1) and carrying the sheet in a direction in which orientation of paper fiber is vertical to the heat fusing roller 1 (indicated as "B" in Table 1). In Table 1, "*" indicates that self-stripping is performed and "" indicates that self-stripping is not performed. At that time, the load of the spring 31** is 8 kgf.

As it can be seen from Table 1, as according to the increase of the load of the spring 32, even a sheet of small basis weight, that is, a thin and soft sheet is apt to easily perform self-stripping. In the case of carrying way of A, paper hardness reduces regarding the paper carrying direction due to paper construction, and therefore it is more difficult to perform self-stripping in the carrying way A than in the carrying way B even though the sheets of the same thickness are used. From Table 1, if it is assumed that the hardest standard of self-stripping is the case of carrying the sheet of 55 g/m$^2$ basis weight in the carrying way A, the load of the spring 32 should be at least 6 kgf.

Figure 5:
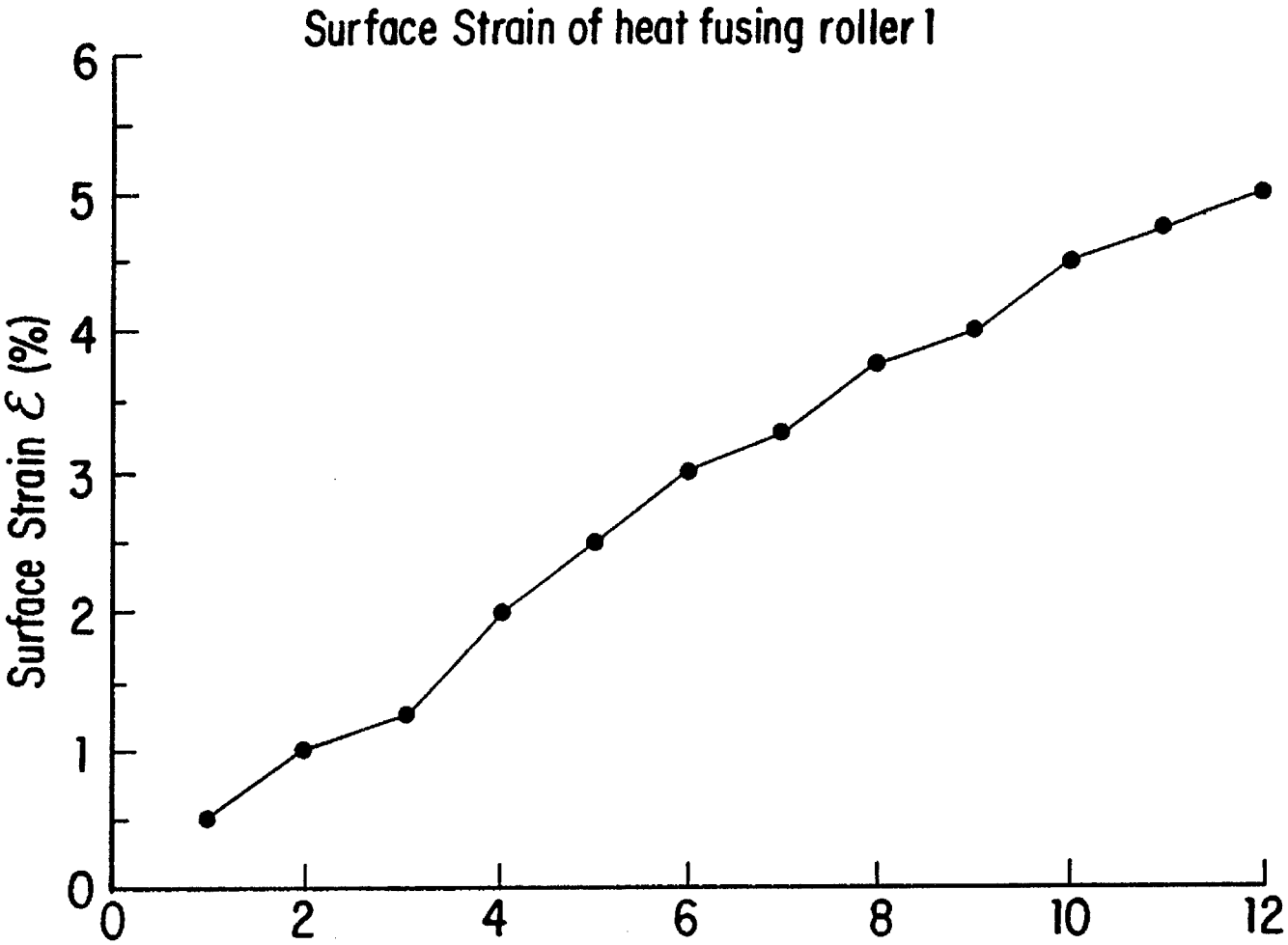
FIG. 5 is a graph showing a relation between strain of surface of the heat fusing roller and a load applied by a spring in the first embodiment of the image fixing device according to the present invention.

FIG. 5 is a graph showing a result of measurement of size of strain $\epsilon$ of the coating layer on the surface of the heat fusing roller 1 by the load of the spring 32. The strain $\epsilon$ is measured in the circumferential direction of the heat fusing roller 1. Suppose that the length of the sheet 7 carried by a rotation of the heat fusing roller 1 is $L_p$ and the circumferential length of the heat fusing roller 1 without strain is $L_r$, The strain $\epsilon$ is represented by the following equality:

$$\epsilon=(L_p/L_r-1)\times 100[\%]$$

As shown in FIG. 5, if the load of the spring 32 is set to be 6 kgf, the strain of the surface of the heat fusing roller 1 is approximately 3.0%.

Now setting of load of the spring 31 is explained. Table 2 shows result of an experiment for investigating the occurrence of the image displacement on condition that the load of the spring 32 is set to be 6 kgf and the load of the spring 31 is changed. The reason of setting of load of the spring 32 to be 6 kgf is that all sheets can perform self-stripping and image displacement is restrained with the load of 6 kgf of the spring 32 in the previous experiment.

TABLE 2

| Load of spring 31 (kgf) | Whether image displacement occurs or not |
|---|---|
| 0 | ** |
| 3 | ** |
| 6 | ** |
| 8 | * |
| 15 | * |
| 20 | * |
| 30 | * |

In Table 2, "" indicates that image displacement which is recognized by visual observation occurs on the sheet 7**, and "*" indicates that no image displacement is found. Based on the result, if the load of the spring 32 is 6 kgf, the load of the spring 31 should be at least 8 kgf.

In the case where the load of the spring 32 is set to be 6 kgf and the load of the spring 31 is set to be 8 kgf, the pressure on the inlet side of the belt nip is 0.36 kgf/cm$^2$ and the highest pressure on the exit side is 0.94 kgf/cm$^2$ approximately. The pressure on the inlet side can be calculated based on the following values: the load of the spring 31 is 8 kgf, and the length and width of the soft-material member 34 are 32 cm and 0.7 cm, respectively; therefore, $8\div(32\times 0.7)=0.36$. The highest pressure at the exit point is obtained based on the following values: the load of the spring 32 is 6 kgf, the length of the hard-material member 35 is 32 cm, and the width of the portion where the hard-material member 35 contacts the endless belt 15 through the low friction sheet 36 is 0.3 cm; therefore, $6\div(32\times 0.3)\times 1.5=0.94$. Here, 1.5 is a multiplier because the pressure distribution at the exit point is not uniform but is parabolic due to circular shape of cross section of the hard-material member 35, and the highest pressure is approximately 1.5 times as high as the average pressure (See FIG. 3).

Second Embodiment

Figure 6:
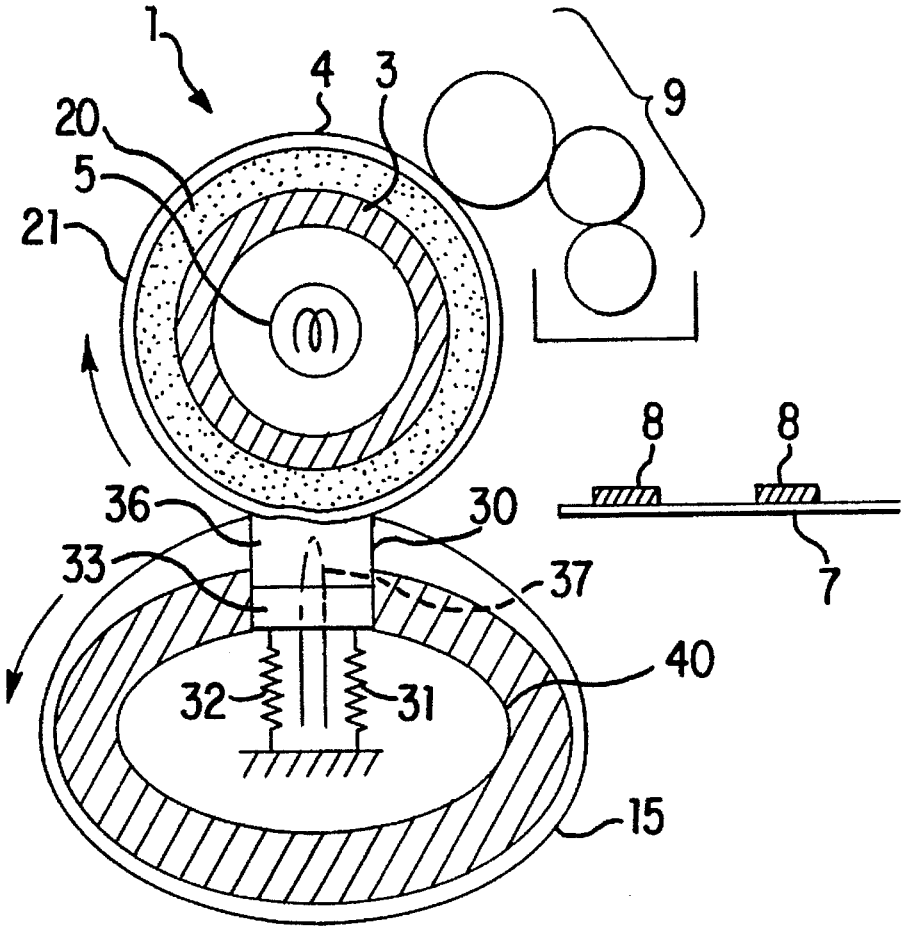
FIG. 6 is a side elevational view showing the construction of a second embodiment of the image fixing device according to the present invention.

FIG. 6 shows a second embodiment of an image fixing device according to the present invention. The second embodiment differs from the first embodiment in the endless belt 15 and a method of supporting thereof, and is similar in using the pressure pad 30 to the first embodiment. In the first embodiment, the endless belt 15 is supported by three rollers 22, 23 and 24, but in this embodiment, the endless belt 15 moves around a single guide 40. The endless belt 15 is made of nickel having 30 μm thickness and is deformed at a belt nip portion between the heat fusing roller 1 and the pressure pad 30 corresponding to deformation of the roller 1 and the pad 30. Other metal may be used as a material of the endless belt 15 as long as it has suitable flexibility.

In the example shown in the figure, the shape of the guide 40 is elliptical, but other shape, for example, a circular guide can be adopted if it does not obstruct movement of the endless belt 15. Various materials can be used for making the guide 40 provided that they have a predetermined rigidity and do not deprive the belt nip portion of too much amount of heat, and do not obstruct the movement of the endless belt 15. For example, the guide 40 can be formed with a wire-gauze or a resin.

Figure 7:
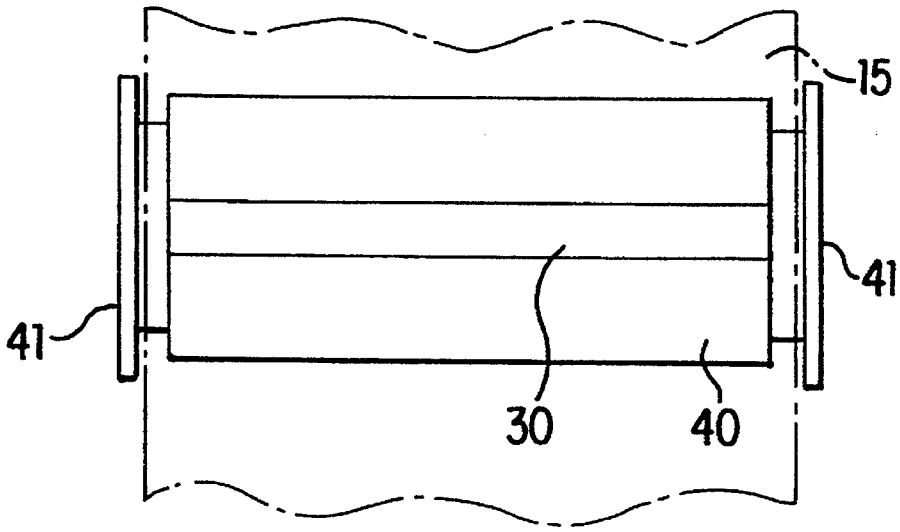
FIG. 7 is a plan view showing a pressure pad and a guide of an endless belt used in the second embodiment of the image fixing device according to the present invention.

FIG. 7 is a plan view showing the guide 40 and the pressure pad 30. Flanges 41 are disposed at both end portions of the guide 40 to prevent the endless belt 15 from shifting toward one side of the heat fusing roller 1 in the axis direction or deviating from the guide 40.

In this embodiment, the endless belt 15 also rotates as according to the rotation of the heat fusing roller 1. Here, the endless belt is made of metal and has rigidity higher than that of the first embodiment which is made of a polyimide film. Therefore, flapping or wrinkling of the belt does not occur although tension is not provided by the rollers. Accordingly, the rollers having been conventionally used for supporting the endless belt is unnecessary, whereby it is possible to simplify and compact the device drastically, and reduce the manufacturing cost.

By mounting the pressure pad 30 which does not rotate as same as in the first embodiment, effects are achieved such as reduction of heat loss in the belt nip, prevention of the image displacement owing to reduction of velocity variation of the sheet 7 in the belt nip or prevention of generation of bubbles. An effect generated by embedding the temperature sensor 37 in the pressure pad 30 is obtained in the same way.

As described above, according to the present invention, the pressure pad is disposed not to rotate; therefore, the heat loss is small and thus economical, and temperature lowering in the belt nip is also reduced, which results in improvement of fixing capability of toner.

Moreover, since the pressure pad presses the endless belt over the whole belt nip area, expansion and vaporization of air or water vapor in the sheet or toner can be restrained, that is, disorder of the unfixed toner by bubbles can be prevented, and it is possible to securely fix the toner by pressing the toner on the sheet passing through the belt nip with the endless belt and the heat fusing roller.

According to another aspect of the present invention, image displacement in the obtained fixed image can be prevented by reducing the velocity variation of the sheet in the belt nip and by decreasing the difference in velocities between the heat fusing roller and the sheet, thus restraining disorder of the image of unfixed toner.

Furthermore, with another aspect of the present invention, temperature in the belt nip can be accurately measured since the temperature sensor is embedded in the pressure pad, whereby temperature control can be performed more appropriately. Wear or damage on the surface of the heat fusing roller is also avoided and prevention of shortening of the life of the heat fusing roller or deterioration of the image quality can be realized.

The foregoing description of preferred embodiment of this invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image fixing device comprising:

a heat fusing roller including heating means inside thereof and an elastic material layer on a peripheral surface of said heat fusing roller;

said heat fusing roller being rotatably mounted;

an endless belt movably in contact with said heat fusing roller; and a non-rotating, pressure-applying member that contacts and applies a force to said endless belt to form a belt nip portion between said endless belt and said heat fusing roller.

2. The image fixing device according to claim 1, wherein said pressure-applying member presses said heat fusing roller through said endless belt so that compression deformation occurs on said elastic material layer of said heat fusing roller.

3. The image fixing device according to claim 2, wherein said pressure-applying member presses said heat fusing roller through said endless belt so that a pressure-contacting force between said endless belt and said heat fusing roller at an inlet side of said belt nip portion is smaller than a pressure-contacting force at an exit side of said belt nip portion.

4. The image fixing device according to claim 3, wherein a friction of a surface of said pressure-applying member contacting with said endless belt is low.

5. The image fixing device according to claim 3, further comprising:

a guide member disposed inside said endless belt for guiding rotation of said endless belt.

6. The image fixing device according to claim 5, wherein said endless belt is rotated in a condition that a part of said endless belt in circumferential direction is not tensioned.

7. The image fixing device according to claim 5, wherein said pressure-applying member comprises a first pressure-applying component whose hardness is higher than the hardness of said elastic material layer of said heat fusing roller and a second pressure-applying component whose hardness is lower than the hardness of said elastic material layer of said heat fusing roller, and said first pressure-applying component is disposed downstream of said belt compared with said second pressure-applying component.

8. The image fixing device according to claim 3, wherein said pressure-applying member comprises a first pressure-applying component whose hardness is higher than the hardness of said elastic material layer of said heat fusing roller and a second pressure-applying component whose hardness is lower than the hardness of said elastic material layer of said heat fusing roller, and said first pressure-applying component is disposed downstream of said belt compared with said second pressure-applying component.

9. The image fixing device according to claim 2, wherein a friction of a surface of said pressure-applying member contacting with said endless belt is low.

10. The image fixing device according to claim 2, further comprising:

a guide member disposed inside said endless belt for guiding rotation of said endless belt.

11. The image fixing device according to claim 10, wherein said endless belt is rotated in a condition that a part of said endless belt in circumferential direction is not tensioned.

12. The image fixing device according to claim 10, wherein said pressure-applying member comprises a first pressure-applying component whose hardness is higher than the hardness of said elastic material layer of said heat fusing roller and a second pressure-applying component whose hardness is lower than the hardness of said elastic material layer of said heat fusing roller, and said first pressure-applying component is disposed downstream of said belt compared with said second pressure-applying component.

13. The image fixing device according to claim 2, wherein said pressure-applying member comprises a first pressure-applying component whose hardness is higher than the hardness of said elastic material layer of said heat fusing roller and a second pressure-applying component whose hardness is lower than the hardness of said elastic material layer of said heat fusing roller, and said first pressure-applying component is disposed downstream of said belt compared with said second pressure-applying component.

14. The image fixing device according to claim 13, wherein said pressure applying member presses said heat fusing roller through said endless belt so that at least 3% of surface strain in a circumferential direction occurs on said elastic material layer of said heat fusing roller.

15. The image fixing device according to claim 2, wherein said pressure-applying member presses said heat fusing roller through said endless belt so that at least 3% of surface strain in a circumferential direction occurs on said elastic material layer of said heat fusing roller.

16. The image fixing device according to claim 1, wherein a friction of a surface of said pressure-applying member contacting with said endless belt is low.

17. The image fixing device according to claim 16, further comprising:

a temperature sensor disposed in said pressure-applying member facing said belt nip portion for measuring a surface temperature of said heat fusing roller.

18. The image fixing device according to claim 17, wherein said surface of said pressure-applying member contacting with said endless belt is covered with a low friction member, and said temperature sensor measures the surface temperature of said heat fusing roller through said low friction member.

19. The image fixing device according to claim 1, further comprising:

a guide member disposed inside said endless belt for guiding rotation of said endless belt.

20. The image fixing device according to claim 19, wherein said endless belt is rotated in a condition that a part of said endless belt in circumferential direction is not tensioned.

* * * * *